US005663561A

United States Patent [19]

Franzen et al.

[11] Patent Number: 5,663,561

[45] Date of Patent: Sep. 2, 1997

[54] METHOD FOR THE IONIZATION OF HEAVY MOLECULES AT ATMOSPHERIC PRESSURE

[75] Inventors: Jochen Franzen, Bremen; Claus Köster, Lilienthal, both of Germany

[73] Assignee: Bruker-Franzen Analytik GmbH, Bremen, Germany

[21] Appl. No.: 623,607

[22] Filed: Mar. 28, 1996

[30] Foreign Application Priority Data

Mar. 28, 1995 [DE] Germany ..... 195 11 336.5

[51] Int. Cl.[6] ..... H01J 49/10

[52] U.S. Cl. ..... 250/288; 250/282

[58] Field of Search ..... 250/288, 282

[56] References Cited

U.S. PATENT DOCUMENTS

| | | | |
|---|---|---|---|
| 4,527,059 | 7/1985 | Benninghoven et al. | 250/288 |
| 5,210,412 | 5/1993 | Levis et al. | 250/288 |
| 5,589,685 | 12/1996 | Jen Wu et al. | 250/282 |

OTHER PUBLICATIONS

Masahiko Tsuchiya et al., *Liquid Ionization Mass Spectrometry of Nonvolatile Organic Compounds*, Analytical Chemistry, vol. 56, pp. 14–19, Jan. 1984.

Ismet Dzidic et al., *Atmospheric Pressure Ionization (API) Mass Spectrometry: Formation of Phenoxide Ions from Chlorinated Aromatic Compounds*, Analytical Chemistry, vol. 47, pp. 1308–1312, Jul. 1975.

J. Yinon et al., *An atmospheric pressure ionization (API) source for a magnetic sector mass spectrometer*, Vacuum, vol. 26, pp. 159–161, Jan. 7, 1976.

Mattanjah S. de vries et al., *Photoionization mass spectrometer with a microscope laser desorption source*, Rev. Sci. Instrum., vol. 63, pp. 3321–3325, Jun. 1992.

Robert J. Cotter, *Laser Desorption Chemical Ionization Mass Spectrometry*, Analytical Chemistry, vol. 52, pp. 1767–1770, 1980.

R.E. Johnson, *Models for matrix-assisted desorption by laser pulse*, International Journal of Mass Spectrometry and Ion Processes, vol. 139, pp. 25–38, 1994.

Stephen G. Anderson et al., *Determination of ion–ligand bond energies of ion fragmentation energies of electrospray–produced ions by collision–induced dissociation threshold measurements*, vol. 141, pp. 217–219, Feb. 20, 1995.

*Primary Examiner*—Jack I. Berman

[57] ABSTRACT

The invention relates to a device and method for the ionization of non-vaporizable substance molecules at atmospheric pressure by chemical ionization (APCI=atmospheric pressure chemical ionization). The invention consists of desorbing the analyte substances which are mixed with decomposable substances (matrix substances) in solid form on a solid support, by laser irradiation at atmospheric pressure into a gas stream, and to add sufficient ions for proton transfer reactions to the gas stream. Explosives like cellulosis trinitrate or trinitro toluene (TNT) form a preferred class of decomposable matrix substances.

12 Claims, 2 Drawing Sheets

METHOD FOR THE IONIZATION OF HEAVY MOLECULES AT ATMOSPHERIC PRESSURE

SUMMARY

The invention relates to a device and method for the ionization of non-vaporizable substance molecules at atmospheric pressure by chemical ionization (APCI=atmospheric pressure chemical ionization). The invention consists of desorbing the analyte substances which are mixed with decomposable substances (matrix substances) in solid form on a solid support, by laser irradiation at atmospheric pressure into a gas stream, and to add sufficient ions for proton transfer reactions to the gas stream. Explosives like cellulosis trinitrate or trinitro toluene (TNT) form a preferred class of decomposable matrix substances.

PRIOR ART

Interest in the mass spectrometric analysis of large molecules, primarily of large biomolecules or polymer molecules, has grown immensely in recent years, and has become possible due to a series of ionization methods for these molecules. In technical literature, the following abbreviations are found for these ionization methods: SIMS (secondary ion mass spectrometry), PD (plasma desorption), MALDI (matrix-assisted laser desorption and ionization), FAB (fast atom bombardment), LSIMS (liquid SIMS), ESI (electrospray ionization). These ionization methods are well-known to the specialist in the field.

Common to all these methods except ESI is their relatively low yield of ions, compared with the flow of neutral molecules. For every 10,000 substance molecules, only about one ion is formed. However, the success of these methods is nevertheless very good because, in principle, from only one attomol of substance (i.e. from about 600,000 molecules) roughly 60 ions can be formed which can generate a just measurable spectrum in suitable mass spectrometers, sufficient for the measurement of the molecular weight. (In practice, suitable spectra were generated from 100 attomols of analyte).

However, it is still a disadvantage of these methods that the sample support must be inconveniently introduced to the vacuum via vacuum locks. Such handling of samples is unfamiliar and unconvenient to biochemical laboratories. It is much more convenient and more common to leave the samples outside the vacuum. Sample supports which must be introduced to the vacuum also make the linking of mass spectrometry with chromatographic and electrophoretic separation methods more difficult.

ESI (electrospray ionization) is one of the most successful ionization methods for large molecules. This method is generally used outside of the vacuum system at normal atmospheric pressure. The ions thus generated can nowadays be relatively effectively channeled into the vacuum, without extreme losses, and fed to the mass spectrometer. In this way, transfer yields between 0.1 and 1% can be achieved, depending on technical design. Since ionization outside the vacuum comes close to 100% yield, spray methods have now become very effective, and have superseded vacuum ionization methods by one to two orders of magnitude.

Nevertheless, not all substances can be ionized using the electro spray method, and the demand for more sensitive methods of ionization from the solid state continues to remain high, since substance preparation is expensive and time-consuming. For instance, substances separated two-dimensionally in gel layers can be better ionized directly from solid surfaces, instead of extracting them individually from the gel or from blot membrane's to obtain sprayable solutions.

OBJECTIVE OF THE INVENTION

A device and a method must be found with which large molecules on a solid sample support, preferably biomolecules, can be transferred from the solid state to a state of ionized single molecules with great effectiveness and subjected to mass spectrometric analysis. Handling of the sample support should be simplified and the complication of vacuum locks should be avoided. The ion yield should be higher than in the methods common today.

BRIEF DESCRIPTION OF THE INVENTION

It is basic to the invention to generate ions from macromolecular substances in an area outside the vacuum, instead within a vacuum, and to separate the ionization process from the desorption process. The processes in vacuum such as PD, MALDI, SIMS or FAB show a mediocre yield of roughly only one ion per 10,000 molecules, mainly because a separation of the ionization process from the desorption process is not feasible. At atmospheric pressure, a considerably higher ionization yield, close to 100%, can be achieved through chemical ionization (APCI), through charge transfer (CE) or through electron capture (EC), so that a substantially increased ion yield is attained from the analysis substance in spite of transfer losses during the transport into vacuum.

This external ionization becomes possible because methods have become known very recently with which ions can be transferred from atmospheric pressure very effectively and economically to mass spectrometric analysis in vacuum. Gas containing the ions can be introduced into the vacuum using suitable capillaries, whereby very high transfer yields for the ions are achieved. Using two-stage turbomolecular pumps with supplementary drag stage, new on the market, for the differential pumping of this type of admission system, has made ion introduction relatively economical. The very effective capture and the guidance of ions in rf ion guides have resulted in transfer yields of ions from atmosphere to the mass spectrometer of up to 1%.

It is the main problem of evaporating the non-volatile analyte substances into the surrounding gas. Therefore it is the basic idea of the invention to support the desorption process by photolytic and thermolytic processes triggered by laser photons. The matrix material should decompose explosion-like into small gas molecules which can blast the analyte molecules into the surrounding gas, similar to the explosion of the matrix material, gasified by laser photons during MALDI, into the surrounding vacuum. While during MALDI the surrounding matrix molecules are generally vaporized as such, and the imbedded, heavy analysis molecules are simply swept together in the cloud of vapor molecules, the matrix molecules in the photolytic and thermolytic processes are broken down into smaller molecules. If matrix substances are selected in such a way that their decomposition products are gaseous in their normal state, the large, embedded analyte molecules are catapulted into the gas phase. Naturally, the matrix material has to be selected such that the transfer of heat to the analyte molecules is minimal.

The macromolecules of the analyte may be embedded in a layer of solid matrix material on a solid support, or may be deposited on top of a matrix layer.

The photolytic or thermolytic decomposition processes of the matrix molecules are initiated by laser light irradiation. Pulsed laser are preferable to continuous wave lasers, since the decomposition then leads to quasi-explosive expansion of a small cloud of decomposition vapor, and the macromolecules are entrained gas-dynamically, hindering them to adsorb again to the sample support. Continuous wave laser irradiation is however also possible if there is good focusing and the sample support and laser focus can be moved relative to one another in such a way that constantly fresh matrix material can be photolytically decomposed.

Explosives form a preferred class of decomposing matrix materials. Cellulosis dinitrate or trinitrate, trinitro toluene (TNT), Xylit, picric acid, and many other nitrogen-rich compounds may be used. These organic explosives decompose into water, carbon monoxide, carbon dioxide, and nitrogen, and are thus ideally suited for this purpose. The explosives may be derivatized to contain chemical groups which help in photon absorption. Most of these organic explosives are not soluble in water, and they can be easily used as a kind of lacquer solved in acetone (nitro lacquers normally use cellulosis dinitrate). Other thermally decomposing substances (e.g. simple sugars) may be added to keep temperatures low. Very thin lacquer layers should be used to keep the explosions limited to small locations. The large molecules may be deposited on top of these layers. The adsorptivity of most of the explosives is rather high.

Metal-organic substances like silver acide or lead acide can be used, too, either as extra layers or as mixtures with organic explosives to lower their initiation temperature.

In contrast to MALDI, at atmospheric pressure the released molecules of the decomposed matrix material are not needed to ionize the macromolecules. The selection of matrix molecules is solely dependent upon their ability to release the large molecules.

This is contrasting to the situation in vacuum where a compromise had to be made during MALDI between absorptive energy acceptance of the matrix by the photons, evaporability and ionization capability, which led to the fact that no common optimal matrix substance has yet been found for all analytes. There are many different matrix substances in use, and often the optimal substance must be determined from case to case in time-consuming steps.

In this invention, the released analyte ions are simply ionized by the well-known process of atmospheric pressure chemical ionization (APCI). Reactant ions are added to the gas stream transporting the analyte molecules after desorption. Favorably an excess amount of ions of medium-sized molecules for positive or negative chemical ionization of the large molecules should be used. The addition of the ions may occur before or after desorption. The rest of these medium-sized molecule ions may be filtered out in the vacuum before they reach the mass spectrometer. The filtering can occur simply by using the ion guiding multipole rod arrangements (e.g. rf quadrupole or hexapole rod system), which do not keep ions below a lower mass cutoff limit. The selection of chemically ionizing reactant gas ions is dependent upon the ionization energies of the biomolecules. The reactant gases should form stable ions in the surrounding gas and their ionization energy must be above that of the large molecules to be ionized. Other than that, there are no limits to the selection at all.

Ionization of the reactant gases can proceed in known manner, for example using a cell with a beta emitter or by corona discharge. It has been shown to be useful to first ionize only slightly moist air or slightly moist nitrogen using the beta emitter or corona discharge. First the nitrogen is ionized, but very quickly water ions are formed which are available exclusively after a short path of the gas and then take over the remaining ionization. Then the reactant gas, e.g. xylene, is mixed into the stream of gas molecules in a concentration of a few percent. The water ions then react very quickly with the reactant gas molecules, forming reactant gas ions which are then the only ones remaining for energy reasons. In contrast to normal chemical ionization, for which methane, ethane or isobutane is preferably used, here it is preferable to use heavier reactant gases. Xylene has proven effective for this purpose since it ionizes the large biomolecules without causing fragmentation. The difference in the ionization energies between xylene and the large biomolecules is so minimal that no surplus energy is available for fragmentation. Additionally, the ionization energy of xylene is lower than the ionization energies of possible contaminants of the surrounding gas so that xylene can be regarded as a relatively universal reactant gas. There is however a large number of substances that are just as favorable as xylene.

Mixing an ion containing gas stream with an analyte containing gas stream may be especially favorable. This mixing may favorably be take place inside the inlet capillary which transfers the ions into the vacuum housing of the mass spectrometer. The ionization yield of large molecules can especially be increased by moving the small reactant ions through an electrical field arranged axially to the flowing gas, similar to what occurs in an Ion Mobility Spectrometer. This may be done inside the inlet capillary. The quantity of collisions of small ions with as many flowing molecules as possible is increased, in that the ions literally plow through the gas.

With the molecule ions of smaller molecules, multiple ionization of heavy molecules can be also accomplished.

It is also possible to add negative ions or thermal electrons to the gas stream in order to generate negative ions from the large biomolecules. This type of ion generation is particularly significant for nucleotides.

FURTHER ADVANTAGES OF THE INVENTION

For certain types of mass spectrometer, it is particularly advantageous that ions in the input capillary of the mass spectrometer can be transported, by viscous friction of the transporting gas, against a potential difference. In this way they can be raised to the acceleration potential of the mass spectrometer. This pumping of ions against a potential difference is automatically combined with a movement of all ions relative to the neutral molecules of the gas, which in turn has a favorable effect upon the ionization yield for large molecules.

Especially advantageous however is the easy handling of the sample support outside of the vacuum. The sample support needs not be inconveniently fed into the vacuum system via a vacuum lock. In a particularly favorable embodiment, the sample support can be placed simply onto a small movement device, and the mass spectrometer is then immediately prepared to scan the spectra.

Also favorable is the possibility of two-dimensional movement of the sample supports at atmospheric pressure. This is, in contrast to movement within the vacuum, extraordinarily simple and economical to set up. Movement in the vacuum is complicated and expensive compared to this, since the drives must remain outside of the vacuum, and the movements must be transmitted via bellows or other transmission elements. Additionally, it is not possible to use lubricants in the vacuum, so very expensive self-lubricating or sliding materials must be used.

The use of glass plates or transparent plastics as sample support plates allows to arrange the laser on the side of the support not carrying the sample. This results in a very simple design of the ion source.

(1) Suction port for moist air, (2) high voltage entry and needle for the corona ionization, (3) ionization chamber for air, (4) reactant gas feeder, (5) workplate with hole for placement of the sample supports (in a movable frame, not shown), (6) window for the admission of focused laser light, (7) sample support with analysis substance on the underside, with a movement device not shown here, movable in two dimensions, (8) focusing lens for the laser light, (9) feeder channel for the mixture of gas and ions into the input capillary,

(10) wall of the vacuum system for the mass spectrometer,

(11) input capillary through which the mixture is introduced into the differential pump system,

(12) first chamber of the differential pump system,

(13) gas skimmer with thru hole for the ions in the wall to the next chamber of the differential pump arrangement,

(14) wall between the first and second chamber of the differential pump system,

(15) second chamber of the differential pump system,

(16) ion guide consisting of a long multipole field with rod-shaped poles,

(17) opening in the wall of the second chamber to the main vacuum chamber of the mass spectrometer,

(18) main vacuum chamber of the mass spectrometer,

(19) end cap of a mass spectrometer based on a quadrupole high frequency ion trap,

(20) ring electrode of the ion trap,

(21) laser for desorption of analysis substance,

(22) pump connection piece of the first chamber of the differential pump system,

(23) pump connection piece of the second chamber,

(24) pump connection piece of the main vacuum chamber of the mass spectrometer.

Figure 2:
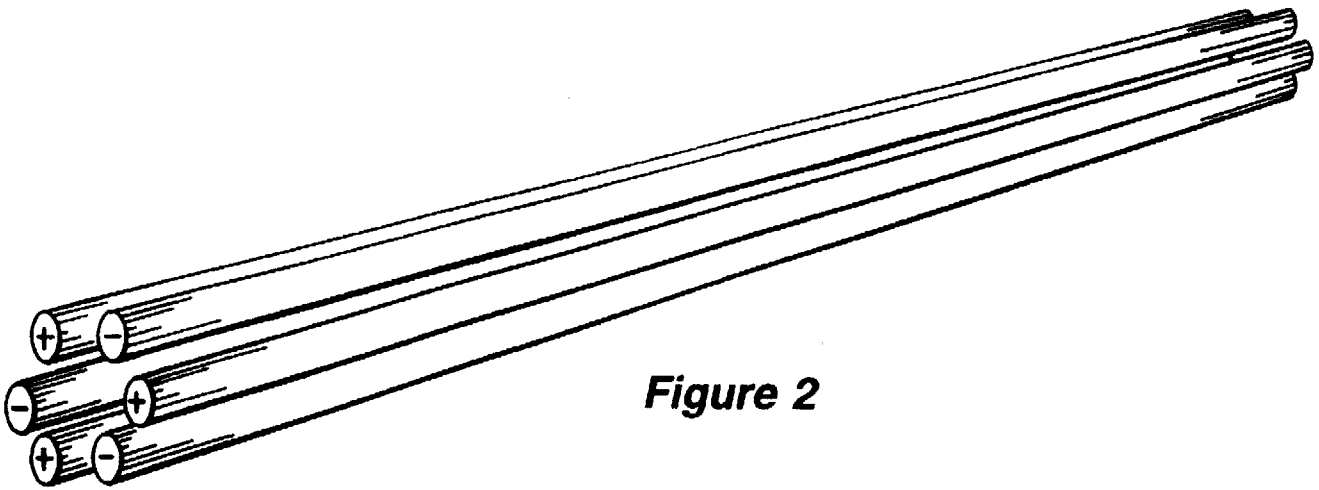

FIG. 2 shows a hexapole arrangement as the ion guide. The pole-rods are charged with a high frequency voltage, whereby the phase alternates between adjacent rods.

Figure 1:
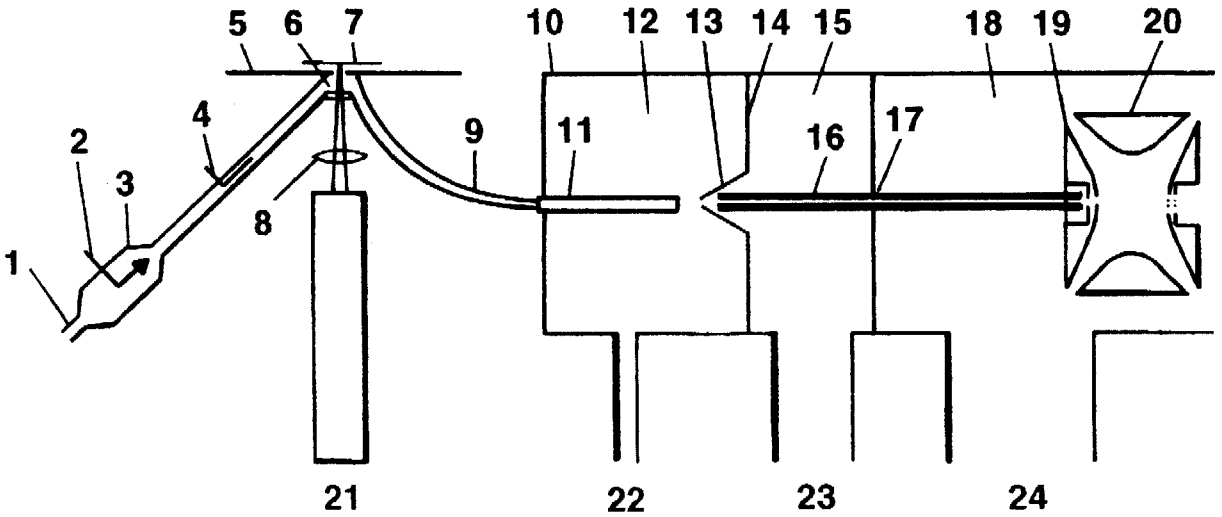
FIG. 1 shows a schematic of a preferred device according to this invention.
Figure 3:
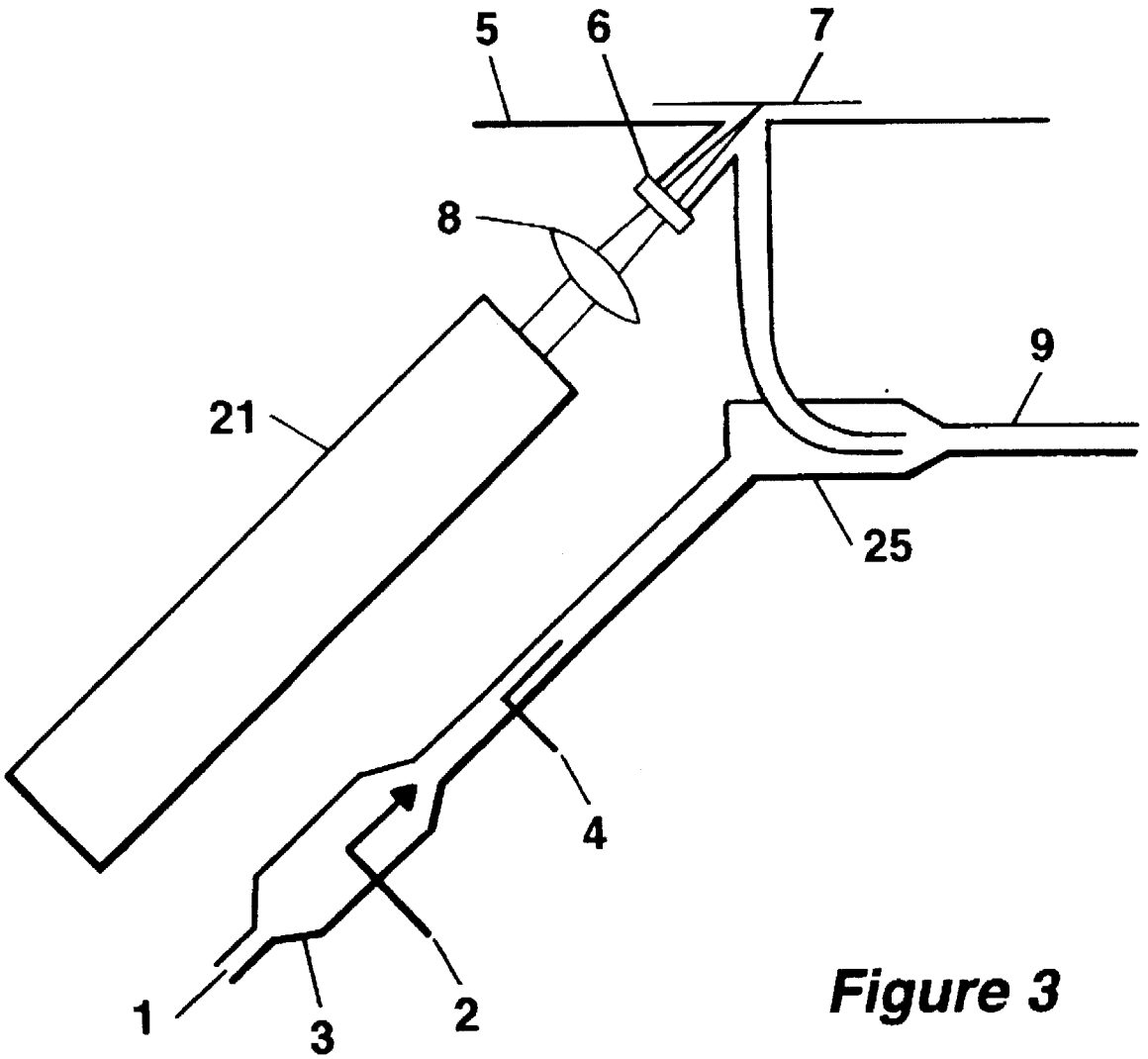

FIG. 3 shows a slightly different arrangement, as compared to FIG. 1, with a mixing chamber (25) in which the gas stream with the sample molecules is enveloped by a gas stream with the reactant gas ions. The arrangement to a large extent prevents collisions of the sample molecules with the wall. The meaning of the other numbers is as in FIG. 1.

PARTICULARLY FAVORABLE EMBODIMENTS

FIG. 1 shows a schematic of a preferred device according to this invention. Through an opening (1), moist air is sucked into an ionization chamber (3), in which a corona discharge develops at a needle (2) connected to high voltage. The corona discharge can also be replaced by a beta emitter on the wall of the ionization chamber (3), for example $Ni^{63}$. When using $Ni^{63}$, the ionization chamber (3) should have a diameter of about 10 millimeters, since the $Ni^{63}$ electrons move a distance of about 6 millimeters before they lose their kinetic energy in air at atmospheric pressure and are stopped. They form most electrons at the end of the distance.

In the ionization chamber (3) nitrogen ions are formed at first almost exclusively, which however quickly react with water molecules $H_2O$ and become water ions $OH^+$ and $OH_2^+$. Through further reactions of the water ions with water molecules, a predominant share of $OH_3^+$ ions is formed. These ions are quite specifically capable of chemical ionization by release of a proton. A low percentage of reactant gas, for example xylene, is mixed into the flowing gas through a feeder (4). Very quickly, the xylene molecules are transformed through protonation by the water ions into energetically favored xylene ions, whereby the water ions disappear. When the gas stream reaches the hole in the workplate (5), almost only xylene ions are left.

The sample support (7) lies above a hole in the workplate (5). The analysis substance is in a very thin layer on the underside of the support plate (7), together with surrounding matrix molecules. The sample support lies in a frame (not shown) of an x-y movement device (also not shown), which maintains a precise distance between the sample support and workplate. In this way the analysis substance is protected from contact with the workplate. Through the precision gap, some surrounding air is also—intentionally—drawn into the gas channel as a second stream. Light flashes of 337 nanometer wavelength are emitted from the low-cost nitrogen laser (21), which fall, focused by the lens (8), through the window (6) and the hole in the workplate (5) onto the sample support and evaporate the matrix molecules there in quasi-explosive deflagrations. At the same time, the analysis molecules are also desorbed into the gas stream. They are entrained by the supplementary second stream, which has penetrated through the precision gap between the support and workplate, and mixes with the mixture of gas and ions.

With transparent support plates, the laser can be positioned above the sample support plate, resulting in a simpler design.

The mixture of air molecules, reactant gas ions, matrix molecules and molecules of the analysis substance is now fed through the channel (9) into the input capillary (11), which passes through the wall (10) of the mass spectrometer into the vacuum. The input capillary, with an inside diameter of 0.5 millimeters and a length of 10 to 15 centimeters, sucks one to two liters of air per minute into the vacuum. This suction stream maintains the gas stream through the suction port (1) into the ionization chamber, the second stream through the gap between the workplate and support plate, and the stream through the channel (9) without needing any additional evacuation. In the channel (9) with a diameter of about 1.5 millimeters, an approximately laminar flow with a central velocity of about 20 meters per second is achieved. The channel (9) is designed appropriately as a cone in order to offer a good transition into the input capillary (11).

Essentially, the analysis molecules are now ionized by chemical ionization at atmospheric pressure (APCI) in channel (9). This ionization is generally very effective and attains roughly a 100% ion yield, if the concentration of reactant gas ions is sufficiently high. Up to 90% or more of the ions are lost however due to wall collisions in the channel (9) and in the input capillary (11), although the yield is still very high. The channel (9) should therefore be kept as short as possible.

At lower concentrations of reactant gas ions it is also possible to develop a portion of the channel (9) by attaching an axially directed electrical field as an ion drift route in order to increase the ionization yield. If the input capillary (11) is used to pump the ions against an electrical potential, an automatic increase in the yield of heavy ions is provided.

In the first chamber (12) of the differential pump unit, which is evacuated via the connection pieces (22) by a prevacuum pump, the ions are accelerated through adiabatic expansion of the gas at the end of the input capillary and simultaneously cooled. They create a tapered beam of about 20° beam width. Through an electrical drawing field (not shown) up to the gas skimmer (13), a considerable part of the ions can be transferred through the opening of the gas skimmer (13), with a diameter of about 1.2 millimeters, and to the second chamber (15) of the differential pump system. In the second chamber (15), the ions are almost completely accepted by the rf ion guide (16), which consists of long pole rods and generates an electrical rf multipole field. The capture of ions by the ion guide is very substantially supported by the gas dynamic processes in the gas skimmer. This ion guide feeds the ions through the chamber (15), through a wall opening (17), and through the main vacuum chamber (18) to the mass spectrometer, modelled here as a high frequency quadrupole ion trap with end caps (19) and ring electrode (20).

The ion guide is preferably modelled as a hexapole arrangement and consists of six approx. 15 centimeter long pole rods, each of only 1 millimeter diameter (see FIG. 2), attached to one another by ceramic holders, not shown. The thin pole rods are arranged along the circumference of a cylinder and surround an empty inner cylinder of only 2 millimeters diameter. With a high frequency voltage of about 600 volts at 3.5 megahertz, this multipole has a lower cutoff threshold for singly charged ions at about 150 atomic mass units. For this reason, the singly charged xylene ions, which when protonated weigh only 107 atomic mass units, do not have stable trajectories and are separated out. Ions of the matrix molecules can also be separated out in this way if their molecular weight is correspondingly selected. Only the heavy ions of the analysis substance, as desired, reach the mass spectrometer.

FIG. 3 shows a slightly different arrangement from that of FIG. 1. The substance, desorbed by the light from the laser (21), is first entrained here by the second stream, which penetrates through the gap between the workplate (5) and support plate (7). The second gas envelopes this stream of sample molecules and prevents collisions of the sample molecules with the wall. The stream of gas with the sample molecules is only enveloped in a mixing chamber (25) with the gas stream which contains the reactant gas ions. These penetrate by diffusion into the central gas stream and cause the chemical ionization of the sample molecules.

In another preferred embodiment the gas streams are mixed inside the inlet capillary into the mass spectrometer by using a y-shaped capillary with two entrance holes. The corona discharge can be arranged directly in front of one of the entrances, the sample support plate with desorption station in front of the other.

It is not absolutely necessary to generate reactant gas ions before mixing with the gas stream that contains the sample molecules. The gas stream can also be ionized with air, water vapor, reactant gas, matrix vapor and sample molecules according to their mixture in the channel (9), for example using a wall coating with $Ni^{63}$.

The support plate (7) can be adjusted on its movement device (not shown) in two directions on the workplate (5). The adjustment is controlled by a computer which allows the positioning of the support plate with substances to be detected two-dimensionally. Plates with two-dimensionally separated substances from two-dimensional electrophoresis can be scanned and examined according to the distribution of proteins or other analysis substances.

The ions can be primed in the input capillary (11) against a high voltage. A high voltage of 6 kilovolts in a 15 centimeter long capillary provides an ion having a mass of 150 atomic mass units, with a relative velocity of 4 meters per second against the gas, due to ion mobility. Heavier ions have slower velocities. Since the velocity of gas flow in the capillary amounts to 500 to 1,000 meters per second however, the ions are forcibly entrained.

By injecting thermal electrons into the gas stream, the process of electron capture can be started. This can additionally be injected into a clean gas easily with the help of a beta emitter, whereby the initial kinetic energy thermalizes very quickly. The electron capture process takes place ideally after mixing with the sample molecules since the electrons escape very quickly.

However, as is also known, negative reactant gas ions can be generated by the electrons at first, if a reactant gas of high electron affinity is used. For ionization with negative ions at atmospheric pressure, the abbreviation APNCI is sometimes used. This type of ionization is especially important for nucleotides.

We claim:

1. Method for the ionization of heavy analyte molecules deposited on a solid support in a gas at atmospheric pressure, comprising the steps of (a) depositing the analyte molecules together with decomposable matrix material on the solid support, (b) decomposing the matrix material by laser photons, thereby blasting the analyte molecules into the surrounding gas, and (c) ionizing the analyte molecules within the gas by the known method of atmospheric pressure ionization.

2. Method as in claim 1, wherein the matrix material consists of explosives.

3. Method as in claim 2, wherein the matrix material consists of a mixture of an explosive with other material.

4. Method as in claim 1, wherein the matrix material forms a lacquer-like layer on the solid support.

5. Method as in claim 4, wherein the analyte molecules are deposited on top of the matrix layer.

6. Method as in claim 1, wherein the analyte material is mixed with the matrix material.

7. Method as in claim 1, wherein the gas stream already contains reactant gas ions for the atmospheric pressure ionization at the location of the introduction of the large molecules.

8. Method as in claim 1, wherein the reactant gas ions of the atmospheric pressure ionization method are fed or formed only after the introduction of the large molecules into the gas stream.

9. Method as in claim 1, wherein the yield of ions from the analyte substance is increased by application of an electrical field axial to the gas flow, causing the ions to move through the gas.

10. Method as in claim 1, wherein the ions are subsequently transferred to a mass spectrometer.

11. Method as in claim 10, wherein the gas stream containing the reactant ions is mixed with the gas stream containing the analyte molecules inside a capillary leading the gas stream into the vacuum system of the mass spectrometer.

12. Method as in claim 10, wherein the reactant ions are filtered out before they reach the mass spectrometer.

* * * * *